US005788096A

United States Patent [19]

Wilcox

[11] Patent Number: 5,788,096

[45] Date of Patent: Aug. 4, 1998

[54] MATERIAL-HANDLING MACHINE WITH HINGED LEG

[75] Inventor: Ronald D. Wilcox, New Berlin, Wis.

[73] Assignee: Harnischfeger Corporation, Milwaukee, Wis.

[21] Appl. No.: 525,128

[22] Filed: Sep. 8, 1995

[51] Int. Cl.[6] ..... B66C 17/00; B66C 19/00

[52] U.S. Cl. ..... 212/312; 212/324; 212/325

[58] Field of Search ..... 212/312, 315, 212/324, 325, 326, 226, 313; 384/396

[56] References Cited

U.S. PATENT DOCUMENTS

| | | | |
|---|---|---|---|
| 903,806 | 11/1908 | Andresen . | |
| 1,177,751 | 4/1916 | Williams . | |
| 2,241,820 | 5/1941 | Köhn | 384/396 |
| 2,333,208 | 11/1943 | Spear | 212/74 |
| 3,181,717 | 5/1965 | Kumferman | 214/394 |
| 3,247,975 | 4/1966 | Holt et al. | 212/13 |
| 3,520,514 | 7/1970 | Evans | 254/139 |
| 3,677,572 | 7/1972 | Fontan et al. | 280/39 |
| 3,704,796 | 12/1972 | Dedons et al. | 214/14 |
| 3,784,029 | 1/1974 | Pelts | 212/14 |
| 3,841,495 | 10/1974 | Dronick et al. | 212/312 |
| 3,863,771 | 2/1975 | Dobbie et al. | 212/325 |
| 3,887,061 | 6/1975 | Hopkins | 198/36 |
| 4,378,072 | 3/1983 | Appleman et al. | 212/218 |
| 4,632,622 | 12/1986 | Robinson | 414/139 |
| 4,648,778 | 3/1987 | Schultz | 414/626 |
| 4,762,239 | 8/1988 | Wissmann et al. | 212/179 |
| 4,830,387 | 5/1989 | Batten | 280/47.331 |
| 4,890,750 | 1/1990 | Stern | 212/153 |
| 4,927,034 | 5/1990 | Holden | 212/153 |
| 4,930,970 | 6/1990 | Sunderland | 212/325 |
| 5,022,542 | 6/1991 | Beier | 212/219 |
| 5,195,204 | 3/1993 | Muller et al. | 14/4 |
| 5,385,249 | 1/1995 | Long, Jr. | 212/218 |

FOREIGN PATENT DOCUMENTS

| | | | |
|---|---|---|---|
| 1445992 | 6/1966 | France | 212/325 |
| 801047 | 12/1950 | Germany | 212/325 |
| 876020 | 3/1953 | Germany | 212/325 |
| 1 431 890 | 11/1965 | Germany . | |
| 1 210 154 | 7/1993 | Germany . | |
| 171106 | 5/1965 | U.S.S.R. | 212/325 |
| 766284 | 10/1954 | United Kingdom . | |
| 918768 | 2/1960 | United Kingdom . | |
| 1233631 | 3/1970 | United Kingdom | 212/325 |

*Primary Examiner*—Karen M. Young
*Assistant Examiner*—R. B. Johnson
*Attorney, Agent, or Firm*—Jansson, Shupe, Bridge & Munger, Ltd.

[57] ABSTRACT

A material-handling machine includes a substantially horizontal girder having an end, a supporting flanged wheel at the end, a truck having rail-riding wheels on a rail and a girder mid-portion extending from the end and connected to a support leg extending between the mid-portion and the truck. The leg and the mid-portion are connected by a pin permitting relative movement between the mid-portion and the leg. Such pinned connection reduces wear of the rail and the rail-riding wheels and reduces bending stress in the support leg.

6 Claims, 6 Drawing Sheets

MATERIAL-HANDLING MACHINE WITH HINGED LEG

FIELD OF THE INVENTION

This invention relates generally to machines having traversing hoists and, more particularly, to gantry cranes.

BACKGROUND OF THE INVENTION

Material-handling machines such as gantry cranes (sometimes referred to as portal cranes) have been in use for decades. A gantry crane has a horizontal bridge or girder which is oriented laterally to the direction of crane travel along a pair of rails. A load-handling trolley, equipped with a hoist drive, rides on other rails atop the girder.

In a full gantry crane, two spaced legs extend downwardly from the girder. Each leg is supported on a separate wheeled end truck riding atop one of two spaced-apart, parallel rails. Material-handling machines embodied as full gantry cranes or closely resembling such cranes are disclosed in U.S. Pat. Nos. 903,806 (Andresen); 4,890,750 (Stern); 5,022,542 (Beier) and others.

A semi-gantry crane has but a single downwardly-extending leg located at or near one end of the girder. The other girder end is supported by an end truck which rides along an elevated rail. In other words, the rails along which a semi-gantry crane travels are at differing elevations.

Gantry cranes are particularly useful in an outdoor application where there is no building to support a pair of elevated rails (as used with an overhead travelling crane) or in situations where only a single elevated rail can conveniently be used. Sometimes full and semi-gantry cranes are equipped with a cantilever portion that extends beyond one of the rails on which the crane travels. Such cantilever portion extends the "reach" of the crane so that loads may be placed to one side.

An aspect of gantry cranes is that the trolley and its suspended load impose bending stresses, sometimes severe, on the leg(s) and on the rigid leg-girder connection(s). The portal crane (a type of full gantry crane) disclosed in German Offenlegungsschrift 1 431 890 has what is described as a torsion-resistant main girder and a hinged leg on one side. Such hinged leg may represent an effort to eliminate or reduce the above-mentioned bending stresses. (If such crane is equipped with a trolley, its existence and location are not apparent from the drawings.)

The portal crane disclosed in the Stern patent addresses the matter of leg-bending stresses in another way. Two of the three legs are flexible.

In a full gantry crane with a cantilever portion, the weight of the leg most distant from such portion helps counterbalance the cantilever portion per se and the weight of the load and trolley when such trolley is atop the cantilever portion. However, there is no counterbalancing leg on a semi-gantry crane. As a result, such cranes are significantly more unstable than a full gantry crane equipped with a cantilever portion. This fact suggests the impropriety of attaching the single leg and the girder to one another using a pivoting connection. To do so would seemingly add to crane instability.

And there is another factor which suggests that using such a pivoting connection on a semi-gantry crane would be improper. Consider the matter of accelerating and decelerating the trolley and its suspended load along the girder. Consistent with Newton's third law of motion, during such acceleration and deceleration when moving toward one end of the girder, an equal and opposite reactive force is directed one or the other of the girder ends, depending upon whether acceleration or deceleration is occurring.

In a full gantry crane having one rigidly-connected leg, such rigid connection resists acceleration and deceleration forces. But in a semi-gantry crane having but a single leg, a pivoting leg-girder connection substantially eliminates the possibility that the single leg can resist the reactive force. These factors may explain why no semi-gantry cranes using a single pivot-connected leg are disclosed in the known prior art.

An improved semi-gantry crane configured to substantially eliminate leg and leg-girder connection bending stresses would be an important advance in the art.

OBJECTS OF THE INVENTION

It is an object of the invention to provide an improved material-handling machine overcoming some of the problems and shortcomings of the prior art.

Another object of the invention is to provide an improved semi-gantry crane which substantially avoids "spreading" of the crane leg toward or away from the elevated end of the crane.

Another object of the invention is to provide an improved semi-gantry crane which substantially avoids imposing bending stresses upon the single leg of such crane.

Yet another object of the invention is to provide an improved semi-gantry crane which substantially avoids imposing bending stresses upon the leg-girder connection of such crane.

Another object of the invention is to provide an improved semi-gantry crane which avoids imposing bending stresses upon the single leg and upon the leg-girder connection even though the crane is equipped with a cantilevered extension member.

Still another object of the invention is to provide an improved semi-gantry crane which accommodates bending of the girder and, if so equipped, of a cantilevered extension member while yet avoiding leg-related bending stresses. How these and other objects are accomplished will become apparent from the following descriptions and from the drawings.

SUMMARY OF THE INVENTION

The invention involves a material-handling machine such as a semi-gantry crane having a horizontal girder and a single downwardly-depending leg extending from such girder. The machine is configured to travel along a pair of parallel rails, one elevated above the other. A powered load-handling trolley is mounted on the girder in a manner that permits such trolley to move along the length of the girder during load handling.

Thus, there are two degrees of freedom of load movement, i.e., parallel to the girder (as the trolley moves along such girder) and parallel to the rails as the machine moves along such rails. And, of course, the fact that the trolley is equipped with a hoist for raising and lowering a load imparts a third degree of freedom of load movement.

The girder has an elevated end and a supporting flanged wheel riding on the elevated rail at such end. The machine also has a truck with wheels riding on another rail spaced from and at an elevation below the elevated rail.

A girder mid-portion extends from the elevated end of the girder and is supported by a support leg coupled between the mid-portion and the truck. The leg and mid-portion are connected by a hinge mechanism having a pin permitting relative movement between the mid-portion and the leg. With such pinned connection, wear of the rail and the rail-riding wheels is reduced.

More specifically, the pin is an elongate pin having a long axis and relative movement between the girder and the leg is permitted only about such axis. The pin long axis is generally parallel to the direction of travel of the machine along the rails.

In a particular embodiment, the machine leg has a pair of struts extending along respective strut axes. An important benefit of using the pinned connection is that the strut axes are maintained substantially linear notwithstanding relative pivoting movement between the mid-portion and the leg. To put it another way, the pinned connection helps prevent bending stresses from being imposed upon the leg as the machine trolley traverses along the girder during load handling.

It is often desirable to configure the girder to have an extension member cantilevered from the mid-portion and extending beyond such mid-portion in a direction away from the girder elevated end. Such extension member enlarges the "reach" of the machine in that it permits placement of loads outside of the area spanned by the machine. The girder mid-portion and the leg define a first angle between them and the extension member and the leg define a second angle therebetween.

In a specific embodiment, these angles are each 90° when the trolley is positioned directly above the leg and does not impose bending forces upon the girder mid-portion or upon the extension member. However, when the trolley is at the mid-portion, the girder bends slightly and the first angle is diminished. Notwithstanding, the strut axes are maintained substantially linear since the pinned connection largely prevents bending forces from being imposed upon the leg and its struts. And when the trolley is at the extension member, the second angle is diminished (because the member bends slightly under the weight of the trolley and its load) while yet retaining the strut axes substantially linear.

In another aspect of the invention, the pin engages at least three bearing surfaces. In one embodiment, at least two of the bearing surfaces are fixed with respect to the girder while in another embodiment, at least two of the bearing surfaces are fixed with respect to the support leg.

Most preferably, the pin engages four bearing surfaces, two of which are fixed with respect to the girder and two of which are fixed with respect to the leg. Those bearing surfaces which are fixed with respect to the support leg may be outboard or inboard of the bearing surfaces fixed with respect to the girder. The former is preferred.

In yet another aspect of the invention, the pin includes grease passages to each bearing surface. More specifically, the pin has first and second ends, grease passages extending to two of the bearing surfaces terminate at the first end and grease passages extending to the other two bearing surfaces terminate at the second end.

Other aspects of the invention are set forth in the following detailed description and in the drawings.

DETAILED DESCRIPTION OF PREFERRED EMBODIMENTS

Figure 1:
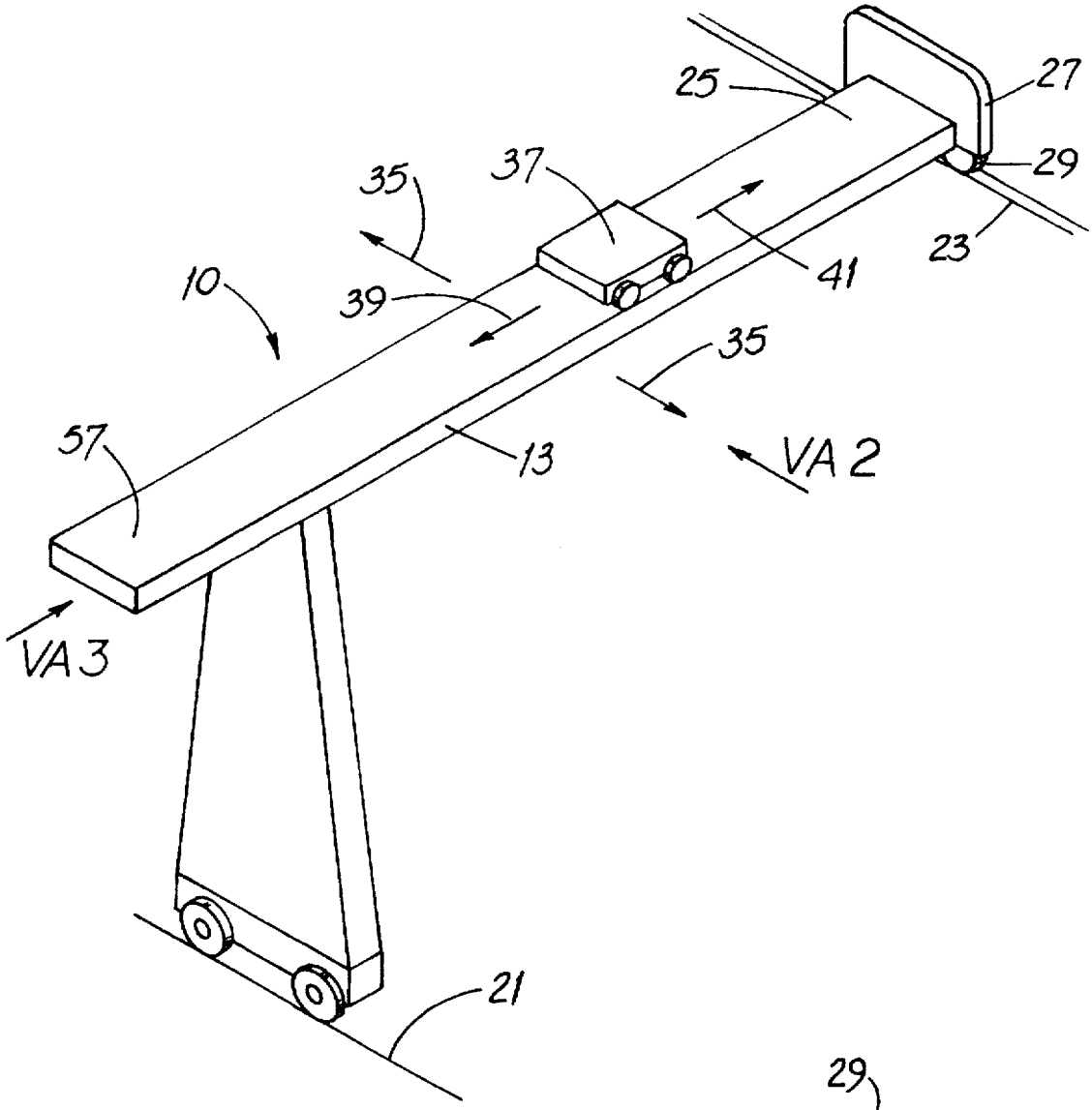
FIG. 1 is a representative perspective view of a material-handling machine embodied as a semi-gantry crane.
Figure 2:
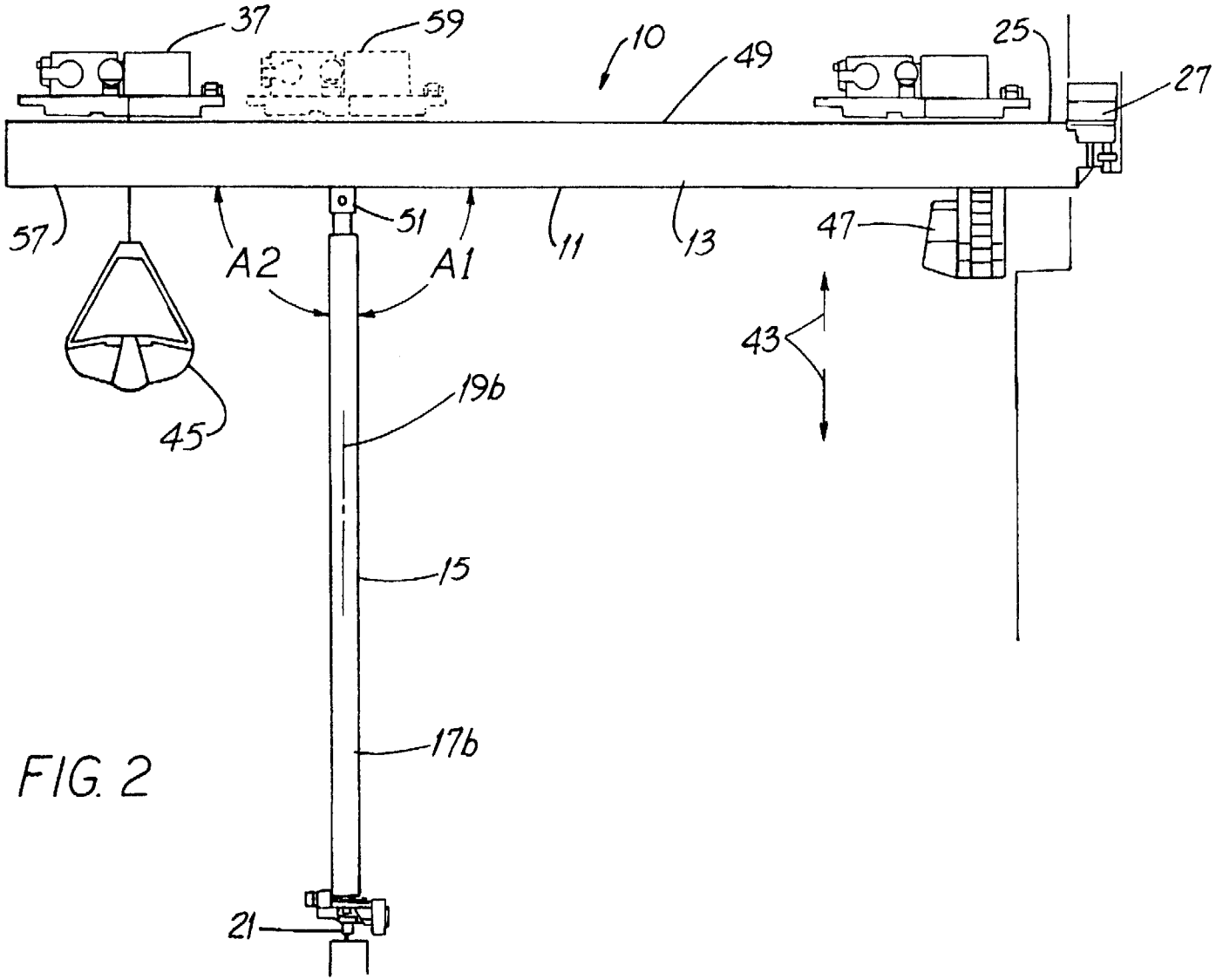
FIG. 2 is an elevation view of a specific semi-gantry crane taken generally along the viewing axis VA2 of FIG. 1. A single trolley is shown in three alternate positions, one of which is in dashed outline.
Figure 3:
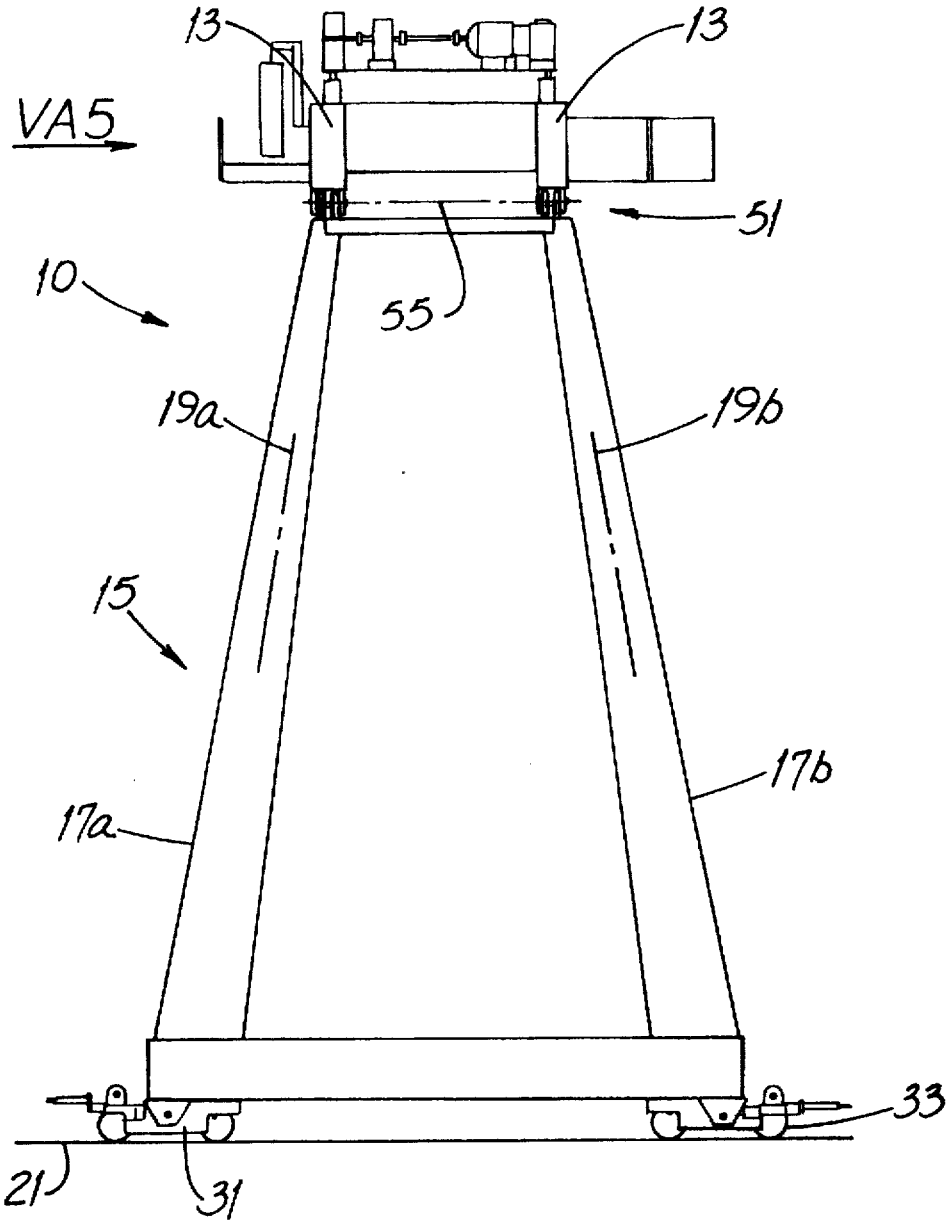
FIG. 3 is an elevation view of the semi-gantry crane of FIG. 2 taken generally along the viewing axis VA3 of FIG. 1.

Referring to FIGS. 1, 2 and 3, a material-handling machine 10 is exemplified by a semi-gantry crane 11 having horizontal girders 13 and a single downwardly-depending leg 15 extending from such girders 13. In a particular embodiment, the leg 15 is forked, shaped generally like an inverted "V" and has a pair of struts 17*a*, 17*b* extending along respective strut axes 19*a*, 19*b*.

The machine 10 is configured to travel along a pair of parallel rails 21 and 23, one of which (rail 23) is elevated above the other. Often, the rail 21 is substantially at ground level and in cross-section, the rails 21, 23 closely resemble those used on railroads.

The ends 25 of the girders 13 are supported by a wheeled truck 27 mounted at such ends 25 and fitted with flanged "rail-riding" wheels 29. Similarly, the support leg 15 is mounted on wheeled trucks 31 fitted with flanged wheels 33. Electric motors power at least one wheel 29, 33 on each truck 27, 31 and the machine 10 is thereby capable of moving along the rails 21, 23 in the opposed directions represented by the arrows 35. A powered load-handling trolley 37 is mounted on the girders 13 in a manner that permits such trolley 37 to move along the length of the girders 13 during load handling. Movement is in directions represented by the arrows 39, 41 and transverse to the directions represented by the arrows 35.

Thus, there are two degrees of freedom of load movement, i.e., parallel to the girders 13 (as the trolley moves along such girders 13) and parallel to the rails 21, 23 as the machine 10 moves along such rails 21, 23. And, of course, the fact that the trolley 37 is equipped with a hoist for raising and lowering a load imparts a third degree of freedom of load movement as represented by the directional arrows 43. All movements of the machine 10, its trolley 37 and its exemplary load-handling bucket 45 are under control of an operator in the machine cab 47.

Referring also to FIGS. 2, 4, 5 and 7, a girder mid-portion 49 extends horizontally from the girder elevated end 25 and such mid-portion 49 is supported by the support leg 15. Connection is by a hinge mechanism 51 having an elongate pin 53 permitting relative movement between the mid-portion 49 and the leg 15. The mechanism 51 is configured in such a way (described in detail below) that relative movement between the girders 13 and the leg 15 is permitted only about the pin long axis 55. Such axis 55 is generally parallel to the direction of travel of the machine 10 along the rails 21, 23.

Referring particularly to FIGS. 1 and 2, it is often desirable to configure the girders 13 to have an extension member 57 cantilevered from the mid-portion 49 and extending beyond such mid-portion 49 in a direction away from the girder elevated ends 25. Such extension member 57 enlarges the "reach" of the machine 10 in that it permits placement of loads outside of the area spanned and traversed by the machine 10.

An important benefit of using the mechanism 51 and its pinned connection is that the strut axes 19*a*, 19*b* are maintained substantially linear notwithstanding relative pivoting movement between the mid-portion 49 and the leg 15 and between the extension member 57 and the leg 15. To put it another way, the mechanism 51 helps prevent bending stresses from being imposed upon the leg 15 as the machine trolley 37 traverses along the girders 13 during load handling. This is further explained using some angular relationships.

Figure 6:
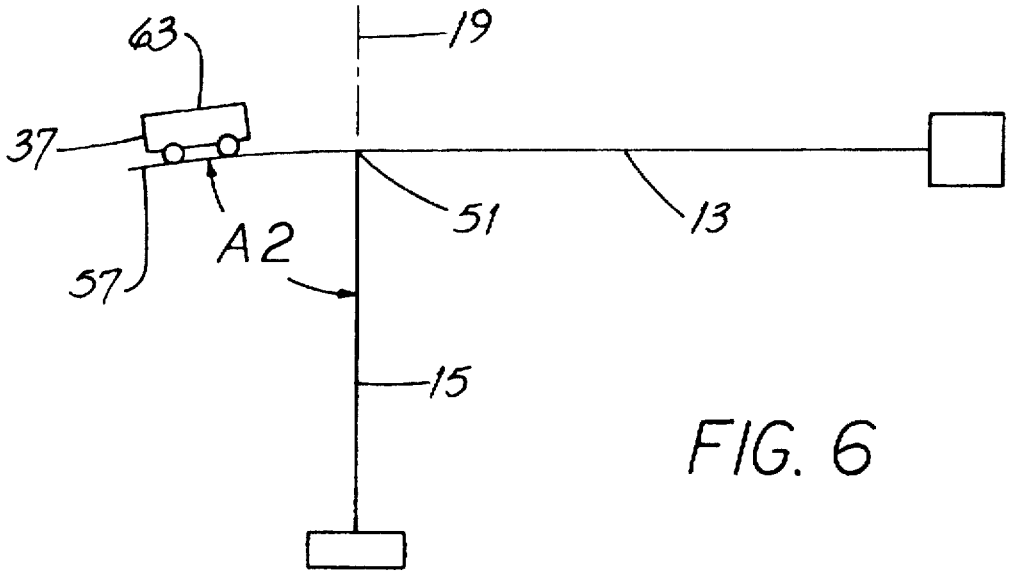
FIG. 6 is a simplified elevation view generally like FIG. 2 and showing the bending effect of certain forces.
Figure 7:
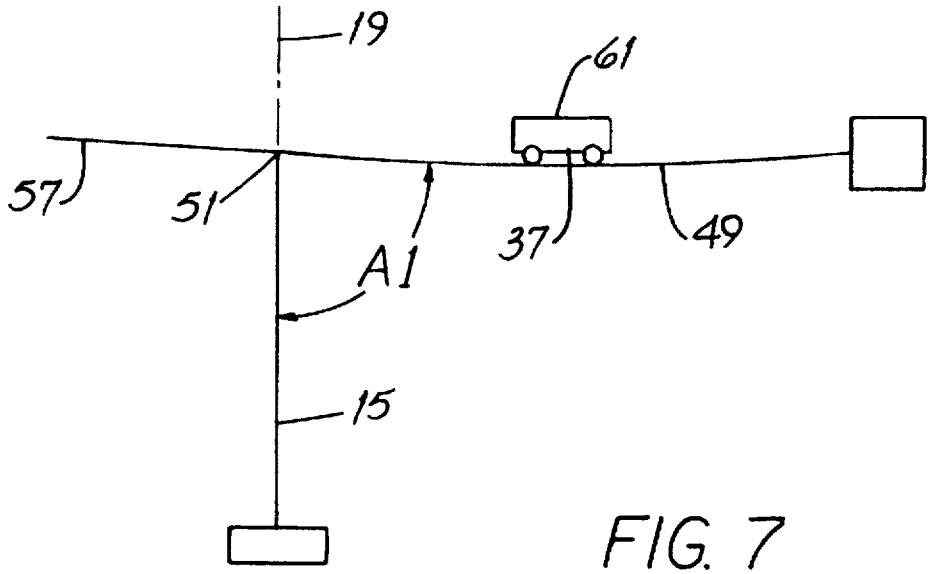
FIG. 7 is a simplified elevation view generally like FIG. 2 and showing the bending effect of certain different forces.

Referring particularly to FIGS. 2, 6 and 7, the girder mid-portion 49 and the leg 15 define a first angle A1 between them and the extension member 57 and the leg 15 define a second angle, A2 therebetween. In a specific embodiment, these angles are each 90° when the trolley 37 is in the position 59, i.e., directly above the leg 15. In position 59, the bucket 45 is not shown. So positioned, the trolley 37 does not impose bending forces upon the girder mid-portions 49 or upon the extension member 57. However, when the trolley 37 is in a position at the mid-portion 49 at, say, the position 61, the girders 13 bend downward slightly as shown in FIG. 7 in an exaggerated way and the first angle A1 is diminished. Notwithstanding, the strut axes 19*a*, 19*b* are maintained substantially linear since the mechanism 51 largely prevents bending forces from being imposed upon the leg 15 and its struts 17*a*, 17*b*. And when the trolley 37 is in a position 63 at the extension member 57, the second angle A2 is diminished (because as shown in FIG. 6 in an exaggerated way, the member 57 bends slightly under the weight of the trolley 37 and its load) while yet retaining the strut axes 19*a*, 19*b* substantially linear.

Figure 4:
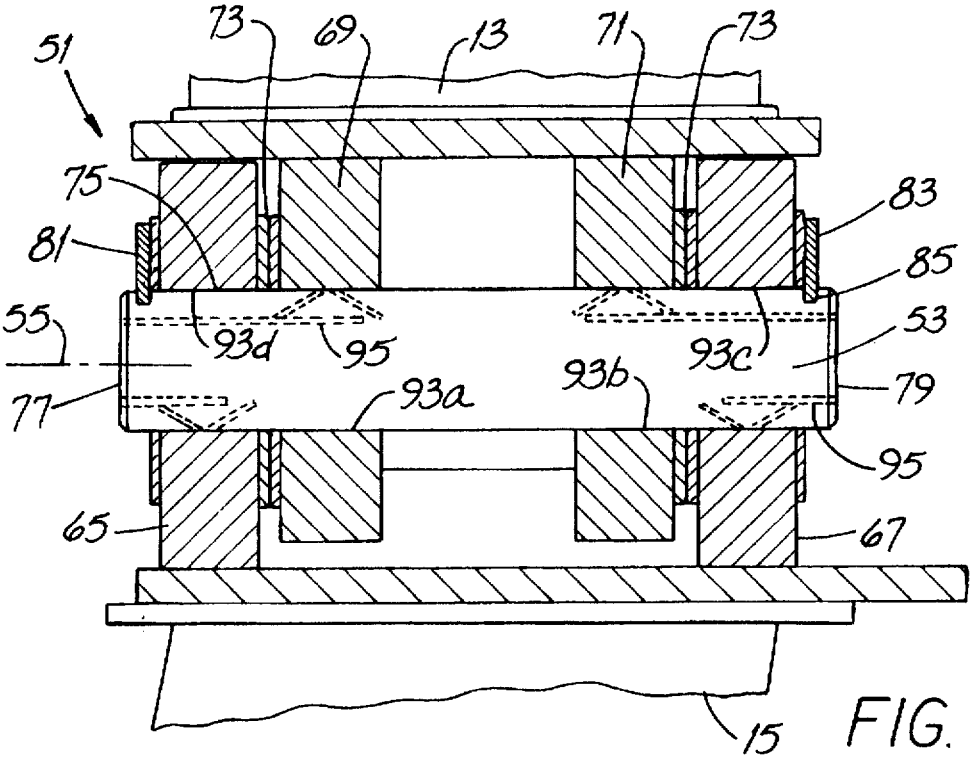
FIG. 4 is an elevation section view of the hinge mechanism used in the semi-gantry crane of FIGS. 2 and 3. Such view is taken along the viewing plane 4—4 of FIG. 5. Parts are broken away and surfaces of other parts are shown in dashed outline.
Figure 5:
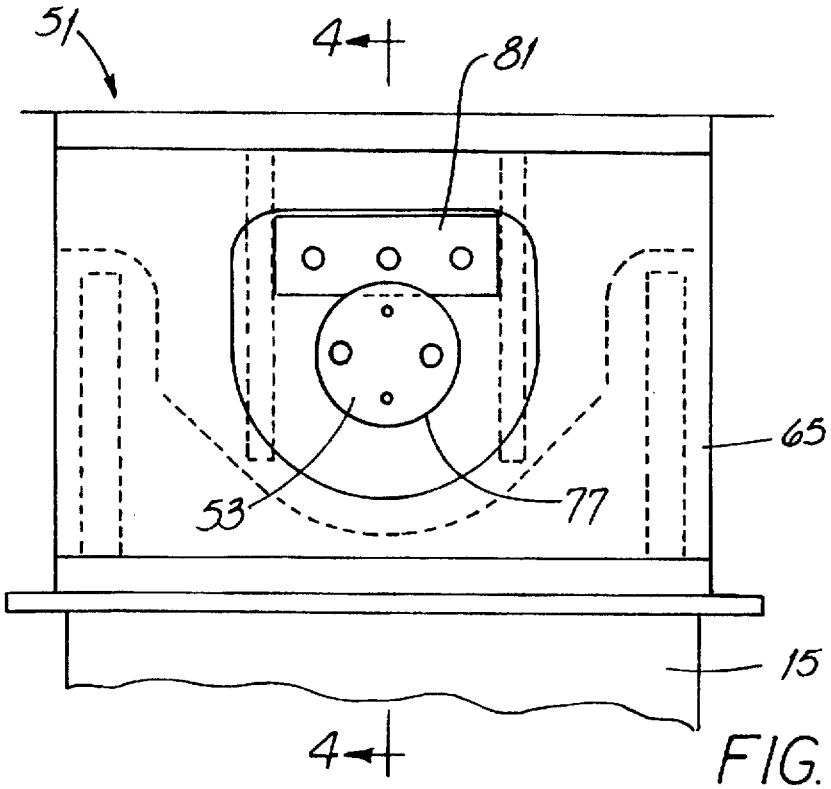
FIG. 5 is an elevation view of the hinge mechanism use in the semi-gantry crane of FIGS. 2 and 3. Such view is taken generally along the viewing axis VA5 of FIG. 3. Parts are broken away and surfaces of other parts are shown in dashed outline.

Referring next to FIGS. 4 and 5, details of the hinge mechanism 51 will now be described. The leg 15 has a pair of spaced, generally-parallel, flat, upstanding leg plates 65, 67 attached thereto by suitable means such as welding. Similarly, the girders 13 have a pair of spaced, generally-parallel, flat, downwardly-depending girder plates 69, 71 attached thereto. The plates 65, 67 are parallel to the plates 69, 71 and adjacent plates (e.g., plates 65 and 69) each include a spacing protrusion 73. Each plate 65, 67, 69, 71 has a generally cylindrical hole 75 formed through it and when the leg 15 and the girder 13 are assembled to one another, the holes 75 are in registry along the pin axis 55.

The elongate, generally-cylindrical pin 53 and the holes 75 in the plates 65, 67, 69, 71 are cooperatively sized so that the pin 53 may be received in the holes 75 with sliding clearance. Near its first and second ends 77 and 79, respectively, the pin 53 is retained in engagement with the plates 65, 67, 69, 71 by keepers 81 and 83 which are attached to the plates 65 and 67, respectively. Such keepers 81, 83 fit "tongue-and-groove" fashion into grooves 85 formed in the pin 53 and prevent the pin 53 from working its way out of the holes 75.

Figure 8:
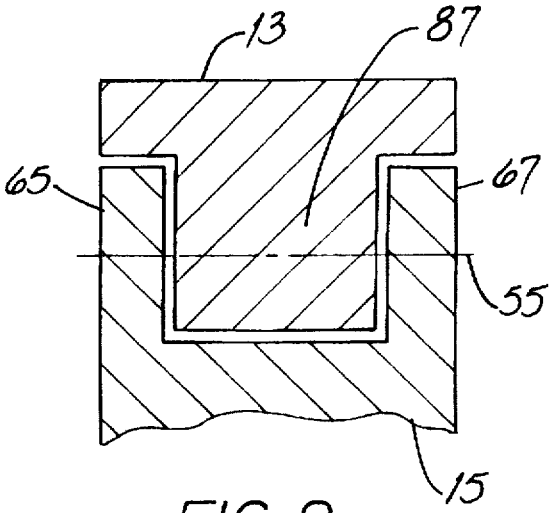
FIG. 8 is an elevation section view generally like that of FIG. 4 showing another embodiment of the hinge mechanism. Parts are broken away.
Figure 9:
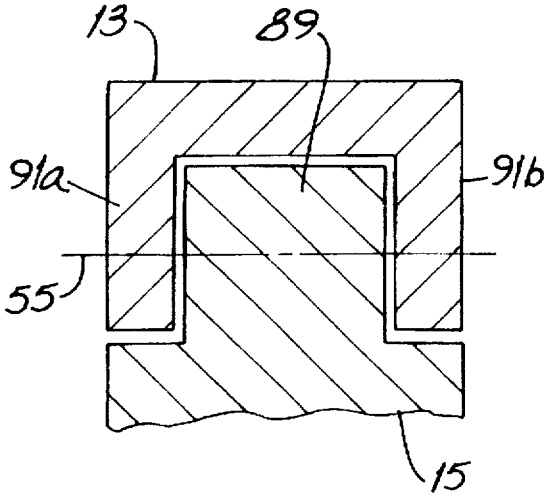
FIG. 9 is an elevation section view generally like that of FIG. 4 showing yet another embodiment of the hinge mechanism. Parts are broken away.

It is to be appreciated that FIGS. 4 and 5 show but one possible embodiment of the mechanism 51. FIG. 8 shows an arrangement in which a girder 13 has a single plate 87 and the leg 15 has two plates 65, 67. FIG. 9 shows another arrangement in which the leg 15 has a single plate 89 and the girder 13 has two plates 91*a*, 91*b*.

Irrespective of the number and arrangement of the plates, the surfaces of the holes 75 therethrough constitute bearing surfaces 93 engaged by the pin 53. In the examples of FIGS. 8 and 9, the pin 53 engages three bearing surfaces 93, at least two such surfaces being fixed with respect to the girder 13 (FIGS. 4 and 9) or fixed with respect to the support leg 15 (FIGS. 4 and 8).

Most preferably, the pin 53 engages four bearing surfaces 93, two of which are fixed with respect to the girder 13 and two of which are fixed with respect to the leg 15. Those bearing surfaces 93 which are fixed with respect to the support leg 15, e.g., surface 93*c* may be outboard or inboard of the bearing surfaces 93, e.g., 93*a*, 93*b* fixed with respect to the girder 13. The former is preferred.

Referring particularly to FIG. 4, the pin 53 includes a grease passage 95 to each bearing surface 93. In a specific embodiment, those grease passages 95 extending to the bearing surfaces 93*a*, 93*d* and terminate at the first end 77 and those grease passages 95 extending to the bearing surfaces 93*b* and 93*c* terminate at the second end 79.

Figure 10:
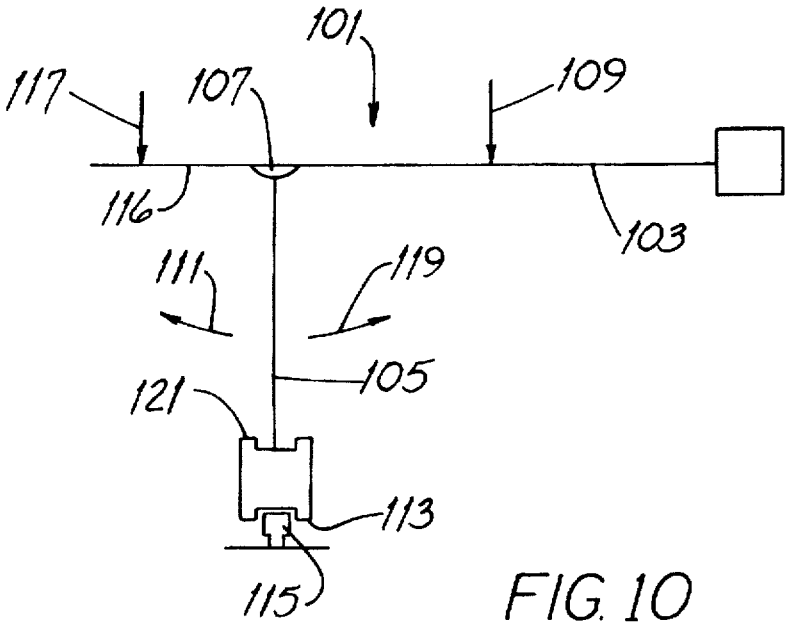
FIG. 10 PRIOR ART
FIG. 10 is a simplified elevation view generally like the views of FIGS. 6 and 7 but showing a prior art semi-gantry crane.

Referring now to FIG. 10, some benefits attending use of the hinge mechanism 51 on the machine 10 will now be explained by way of contrast with a machine 101 which lacks such mechanism 51 and on which the girder 103 and leg 105 are rigidly connected to one another at the location 107. Considering FIG. 10, if the trolley exerts a force on the girder 103 along the arrow 109, there is a tendency for the leg 105 to be urged outwardly as represented by the arrow 111. The inside wheel flanges 113 are urged against the rail 115 and both undue rail and wheel wear result. If the trolley exerts a force on the extension member 116 along the arrow 117, there is a tendency for the leg 105 to be urged inwardly as represented by the arrow 119. The outside wheel flanges 121 are thereby urged against the rail 115 with the same undesirable result.

And that is not all. Forces along the arrows 109 or 117 tend to bend and stress the leg 105 and stress the rigid connection at location 107 between the leg 105 and the girder 103. Earlier failure is a distinct possibility.

In contrast (and referring to FIGS. 2, 6 and 7), loading as shown in FIGS. 6 and 7 will bend the girders 13 or the extension member 57. But because of the hinge mechanism 51, such bending forces are isolated from the leg 15 and from the wheel flanges and rail 21.

Figure 11:
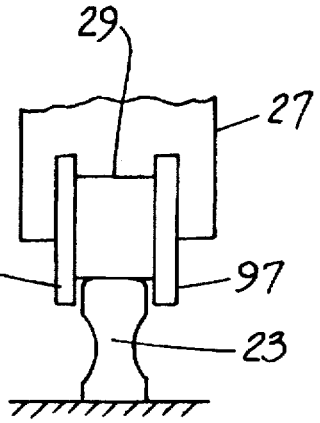
FIG. 11 is a representative view of a portion of the elevated end truck on the crane of FIGS. 2 and 3, including a double-flanged wheel and the rail upon which such wheel rides. Parts are broken away.

Referring also to FIG. 11, in a highly-preferred embodiment, the flanged wheels 29 on the truck 27 at the ends 25 of the girders 13 include two flanges 96, 97, one flange 96 being adjacent to the inward edge of the rail 23 and the other flange 97 being adjacent to the outward edge of the rail 23. When a flange 96, 97 contacts an edge, such flange-rail engagement resists movement of the crane girders 13 in the direction of the arrows 39, 41.

While the principles of the invention have been shown and described in connection with one or more preferred embodiments, it is to be understood clearly that such embodiment(s) are by way of example and are not limiting. As but one example, the invention is suitable for use with semi-gantry cranes 10 having single or multiple girders 13.

What is claimed:

1. In combination, first and second rails and a material-handling machine supported on the first and second rails at differing elevations for movement in a direction of travel, the machine including:

a pair of substantially horizontal, spaced-apart girders, each having an end and a girder mid-portion;

a trolley supported by the girders and having a hoist apparatus mounted thereon;

supporting flanged wheels at the ends and riding on the first rail;

a truck having wheels riding on the second rail below the first rail; and a support leg;

and wherein:

the girder mid-portions extend from the respective ends and connect to the support leg at a position between the mid-portions and the truck;

and wherein:

each girder has at least one substantially flat girder plate rigidly attached thereto and extending downwardly therefrom;

the support leg has at least two substantially flat leg plates extending upwardly therefrom;

the girder plate and the leg plates are generally perpendicular to the direction of travel;

each leg plate is horizontally spaced from the girder plate by a spacing protrusion;

at least one pin extends through the girder plate and the leg plates;

the pin has a horizontal pin long axis extending in the direction of travel;

the machine includes a keeper affixed to one of the plates;

the pin is retained in engagement with the plates by the keeper engaging the pin;

the leg and mid-portions are free to pivot relative to one another only about the pin long axis, thereby reducing wear of the rails and the rail-riding wheels;

the pin engages a plurality of bearing surfaces;

at least one of the plurality of bearing surfaces is on one of the girder plates;

at least another one of the plurality of bearing surfaces is on one of the leg plates;

and wherein:

the pin has first and second ends and includes a grease passage to each of the said plurality of bearing surfaces;

the grease passage to the said one of the plurality of bearing surfaces terminates at the first end; and the grease passage to the said another one of the plurality of bearing surfaces terminates at the second end.

2. The machine of claim 1 wherein the pin engages at least three bearing surfaces and at least two of the bearing surfaces are on the girder plates.

3. The machine of claim 1 wherein the pin engages at least three bearing surfaces and at least two of the bearing surfaces are on the leg plates.

4. The machine of claim 1 wherein:

the pin engages four bearing surfaces;

two of the bearing surfaces are on the girder plates; and the other two of the bearing surfaces are on the leg plates.

5. The machine of claim 4 wherein the bearing surfaces on the leg plates are outboard of the bearing surfaces on the girder plates.

6. The machine of claim 4 wherein the pin includes grease passages to each of the four bearing surfaces;

grease passages extending to two of the bearing surfaces terminate at the first end; and grease passages extending to the other two bearing surfaces terminate at the second end.

* * * * *